US007251980B2

(12) United States Patent
Gallentine et al.

(10) Patent No.: US 7,251,980 B2
(45) Date of Patent: Aug. 7, 2007

(54) HYDRAULICALLY POWERED GRIPPING TOOL

(75) Inventors: Bill Gallentine, Hood River, OR (US); Myron D. Tupper, Boring, OR (US); Ovidiu Salagean, Hillsboro, OR (US)

(73) Assignee: LatchTool Group LLC, Colorado Springs, CO (US)

( * ) Notice: Subject to any disclaimer, the term of this patent is extended or adjusted under 35 U.S.C. 154(b) by 0 days.

(21) Appl. No.: 11/401,314

(22) Filed: Apr. 11, 2006

(65) Prior Publication Data

US 2006/0230810 A1 Oct. 19, 2006

Related U.S. Application Data

(60) Provisional application No. 60/670,698, filed on Apr. 13, 2005.

(51) Int. Cl.
*B21J 9/18* (2006.01)
*B21J 15/20* (2006.01)
*B21D 37/04* (2006.01)

(52) U.S. Cl. ..... 72/449; 72/453.15; 72/453.16; 72/409.01; 72/409.07; 81/348

(58) Field of Classification Search ..... 72/453.15, 72/453.16, 453.04, 449, 409.07, 409.01; 81/356, 357, 363, 367, 368, 348
See application file for complete search history.

(56) References Cited

U.S. PATENT DOCUMENTS

| | | | | |
|---|---|---|---|---|
| 2,208,058 | A * | 7/1940 | Smith | 72/407 |
| 2,224,708 | A * | 12/1940 | Van Sittert | 72/453.15 |
| 2,487,281 | A * | 11/1949 | Steckelberg | 81/368 |
| 4,351,097 | A * | 9/1982 | Hashimoto et al. | 81/301 |
| 4,475,374 | A * | 10/1984 | Sakai et al. | 72/453.15 |
| 5,806,362 | A * | 9/1998 | Dubugnon | 72/453.04 |
| 6,415,641 | B1 * | 7/2002 | Wagner | 72/453.16 |

* cited by examiner

*Primary Examiner*—David Jones
(74) *Attorney, Agent, or Firm*—Manelli Denison & Selter PLLC; Edward J. Stemberger

(57) ABSTRACT

A hydraulic operated tool includes a body (B), a pair of jaws (21) mounted with respect to the body so that at least one of the jaws is movable between an opened jaw position and a closed jaw position so as to engage workpiece (W) between the jaws. A ram assembly (2) is disposed in the body and is operatively associated with the jaws. Spring structure (1) causes the ram assembly to move thereby causing the jaws to initially engage the workpiece with a first force. A pump assembly (7) exerts fluid on the ram assembly to move the ram assembly further, causing the jaws to exert a second force, greater than the first force, on the workpiece.

32 Claims, 3 Drawing Sheets

HYDRAULICALLY POWERED GRIPPING TOOL

This application is based on U.S. Provisional Application No. 60/670,698, filed on Apr. 13, 2005 and claims the benefit thereof for priority purposes.

FIELD OF THE INVENTION

The invention relates to fluid operated devices such as hand tools and, more particularly, to a gripping tool such as locking pliers.

BACKGROUND OF THE INVENTION

Conventional locking pliers such as the Vise-Grip® pliers having a mechanical system that once tripped, allows the pliers to stay latched on to the work that it has grasped. However, it takes substantial hand strength to set the conventional locking pliers and even more strength to release its hold on the work.

There is a need to provide a hydraulically powered hand tool that requires a relatively low input force, provides significant output force, and that is easy to disengage from the work.

SUMMARY OF INVENTION

An object of the invention is to fulfill the need referred to above. In accordance with the principles of the present invention, this objective is achieved providing a hydraulically operated tool including a body, a trigger mounted for movement between first and second positions with respect to the body, a pair of jaws mounted with respect to the body so that at least one of the jaws is movable between an opened jaw position and a closed jaw position so as to engage work between the jaws, jaw actuating structure associated with the jaws to cause movement of the at least one jaw, a ram assembly having first and second ends and including a valve actuating structure and a ram piston, the valve actuating structure having first and second ends, the first end of the ram assembly being coupled with the jaw actuating structure, a first check valve associated with the ram piston, a second check valve associated with the ram piston and with the second end of the valve actuating structure, a lever associated with the first end of the valve actuating structure and with the ram assembly, surfaces defining a cavity in the body, the cavity having hydraulic fluid therein, the ram piston being disposed in the cavity separating the cavity to define a ram chamber and a reservoir chamber, spring structure engaging a second end of the ram assembly, and a pump assembly operatively associated with the trigger to be movable between a first position, when the trigger is in the first position, and a second position when the trigger is in a second position, the pump assembly having a pump chamber in selective fluid communication with the ram chamber and the reservoir chamber. When the lever is moved to an activated position, the valve actuating structure unseats the second check valve permitting fluid to flow from the ram chamber to the reservoir chamber, with the ram assembly displacing fluid as it compresses the spring structure and causes the jaw actuating structure to move the at least one jaw so work can be placed between the jaws. When the lever is released from the activated position, the second check valve is seated and the spring structure drives the ram assembly to an extended position causing the jaw actuating structure to move the at least one jaw so the jaws engage the work, with the first check valve being unseated by fluid pressure in the reservoir chamber, permitting fluid to flow from the reservoir chamber to the ram chamber. When the trigger is moved from the first position to the second position, the pump assembly moves to the second position thereof and forces fluid from the pump chamber into the ram chamber causing the first check valve to seat, with the forced fluid being exerted on the ram piston, increasing force of the jaws on the work.

In accordance with another aspect of the invention, a method of applying force to workpiece provides a hydraulic tool having a pair of jaws constructed and arranged to receive the workpiece there-between. The tool includes a ram assembly operatively associated with the jaws. The ram assembly is caused to move thereby causing the jaws to initially engage the workpiece with a first force. Fluid is exerted on the ram assembly to move the ram assembly further, causing the jaws to exert a second force, greater than the first force, on the workpiece.

Other objects, features, functionality and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawing, in which.

DETAILED DESCRIPTION OF THE EXEMPLARY EMBODIMENTS

Figure 2:
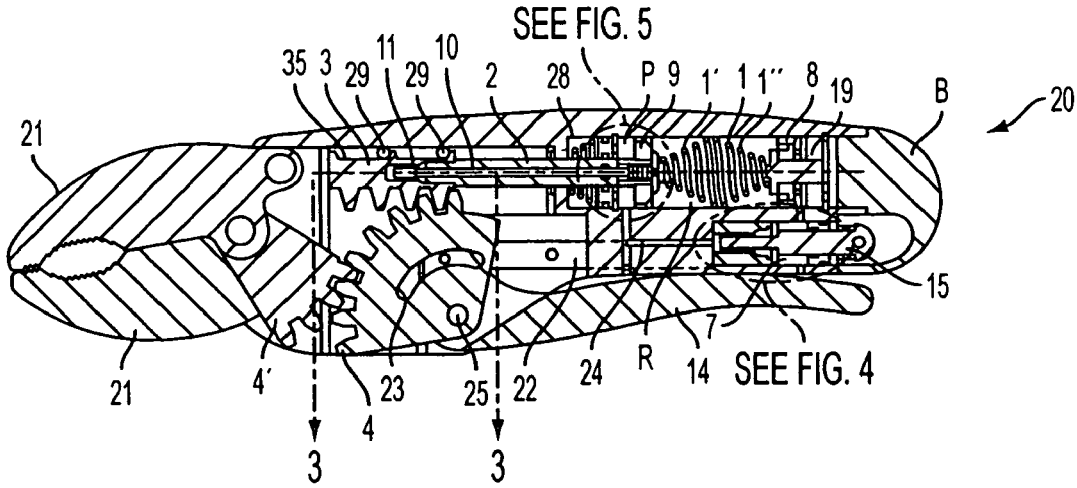
FIG. 2 is a sectional view taken along the line 2-2 in FIG. 1.

With reference to FIG. 2, a hydraulically operated gripping tool is shown, generally indicated at 20, in accordance with the principles of the present invention. The tool 20 includes a pump assembly 7, a ram assembly 2, conventional vise grip jaws 21, and actuating structure for causing movement of at least one of the jaws 21. In the illustrated embodiment, the actuating structure in the form of gears 3, 4 and 4'. Also, spring structure 1 is associated with the ram assembly 2 in a cavity 28. Cavity 28 is fully filled with fluid and is divided by a ram piston 9 of the ram assembly 2 into a ram chamber R and a reservoir chamber P, the function of which will be explained below.

The tool 20 has a main body B and a trigger 14 mounted for movement between opened and closed positions with respect to the body B. Links 22 (one shown in FIG. 2) straddle the gear segments 4 and the pump assembly 7 and connect the trigger 14 to a pump piston 15 of the pump assembly 7, preferably by pin connections. A slot 23 in the large gear segment 4 makes it possible to pivot the trigger 14 and the large gear segment 4 on the same shaft 25. The trigger 14 is normally in a closed position and can be opened by pressing a button 38 associated therewith.

Figure 1:
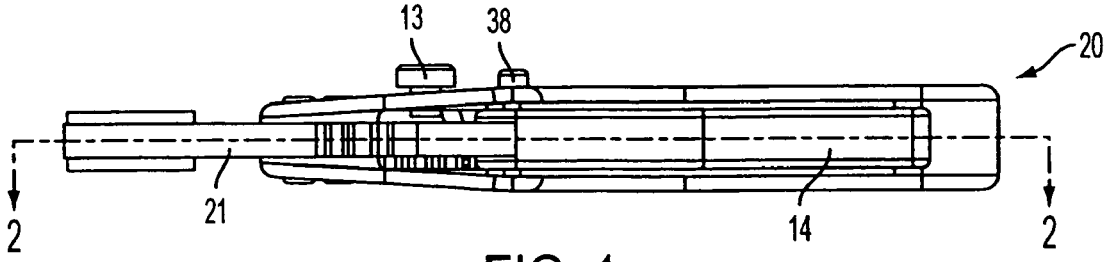
FIG. 1 is a bottom view of a fluid operated tool provided in accordance with the principles of the present invention, shown with jaws in a closed position.
Figure 3:
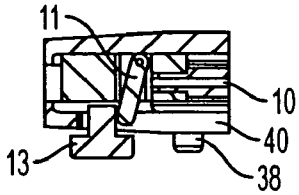
FIG. 3 is a sectional view taken along the line 3-3 in FIG. 2.

Starting from the jaw-closed position and with no positive pressure in ram chamber R, the jaws 21 are opened and fluid is redistributed by manually moving to the right in FIG. 3, a slider 13 (FIGS. 1 and 3) engaged with a lever 11. The slider 13 moves in a slot 40 in the body B and the slider 13 can be considered to be part of the lever 11. The lever 11 is associated with the ram assembly 2 and thus is associated with the gear rack 3 of the jaw actuating structure. Thus, activating and holding the slider 13 and thus lever 11 causes a valve actuating structure or push rod 10 (FIGS. 3 and 5), coupled with the ram assembly 2, to move and unseat a check valve 12 in the form of a ball member. More particularly, the lever 11 acts on the distal end of the push rod 10 proximal to the rack gear 3. At the other end of the push rod 10 or ram end, the push rod 10 bears against the check valve (e.g., ball) 12 in the center of a ram piston 9. The check valve 12 is opened when a force is exerted on the push rod 10 by the lever 11, redistributing fluid displaced by a ram piston 9 (of the ram assembly 2) as it compresses the spring structure 1. Thus, fluid is permitted to move from the ram chamber R through the ram piston 9 to the reservoir chamber P. Although a ball-type check valve 12 is shown, it can be appreciated that a dart-type check valve can be employed.

Simultaneously as unseating of check valve 12 due to moving the slider 13 and lever 11 to the right as noted above, the gear rack 3 rotates the gear segments 4 and 4', opening at least one of the jaws 21.

Figure 5:
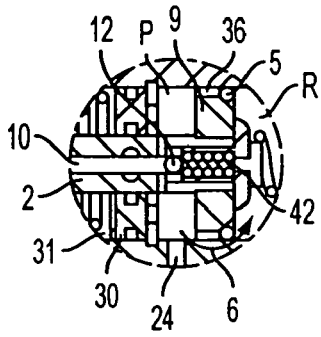
FIG. 5 is an enlarged view of the portion encircled in FIG. 2.
Figure 6:
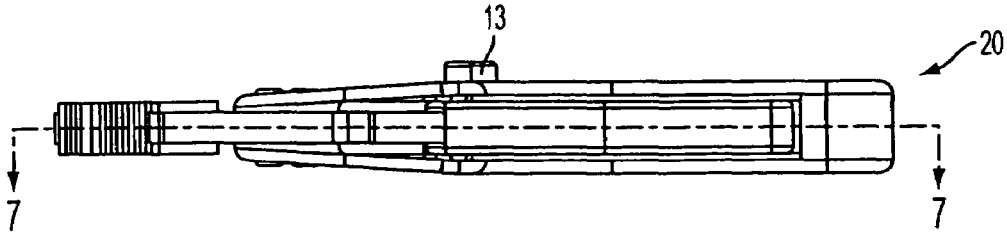
FIG. 6 is a bottom view of a fluid operated tool provided in accordance with the principles of the present invention, shown with jaws in an opened position.

The jaws 21 of the tool 20 are then placed around the work W (FIG. 7) to be grasped and the slider 13 and thus lever 11 is released. Consequently, the spring structure 1 expands rapidly driving the push rod 10 and gear rack 3 combination to the left in FIG. 2 with the jaws 21 fully engaging the work. Release of slider 13 and thus lever 11 causes the check valve 12 to seat due to the bias of spring 42 (FIG. 5). As the spring structure 1 expands, fluid collected in reservoir chamber P during spring compression unseats O-ring 5 (FIG. 5) on the outside diameter of the ram piston 9 and flows from reservoir chamber P into ram chamber R as depicted by arrow 6 in FIG. 5. The ram piston 9 with O-ring 5 defines a check valve member of the type described in U.S. Pat. No. 6,341,621, the contents of which is hereby incorporated into the present specification by reference. Thus, the ram piston 9 is movably disposed in a bore 36 in the body B and the O-ring 5 is disposed between peripheral surface of the ram piston 9 and the surfaces defining the bore 36. The O-ring 5 preferably has a circular cross-section, but can have any desired cross-sectional configuration.

The ram piston 9 moves through the fluid as the spring structure 1 pushes it forward (towards the left in FIG. 2). However, since the volume in ram chamber R increases more than the decrease of volume in reservoir chamber P, a spring loaded (via spring 31) reservoir piston 30 (FIG. 5) is provided to make-up the volume difference. This compound action of moving slider 13 to the right activating lever 11, placing the jaws 21 around the work and then releasing slider 13 completes the first task of rapidly engaging the work.

Figure 4:
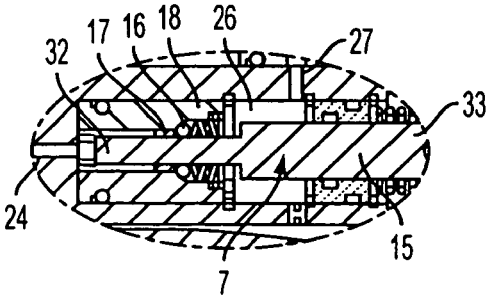
FIG. 4 is an enlarged view of the portion encircled in FIG. 2.
Figure 7:
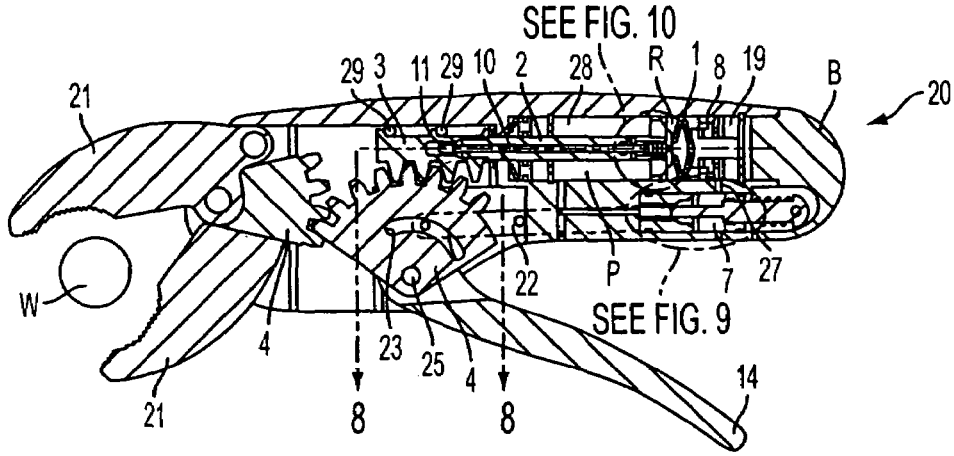
FIG. 7 is a sectional view taken along the line 7-7 in FIG. 6.
Figure 8:
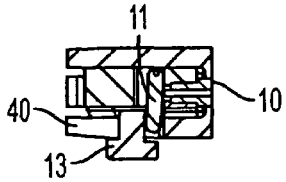
FIG. 8 is a sectional view taken along the line 8-8 in FIG. 7.
Figure 9:
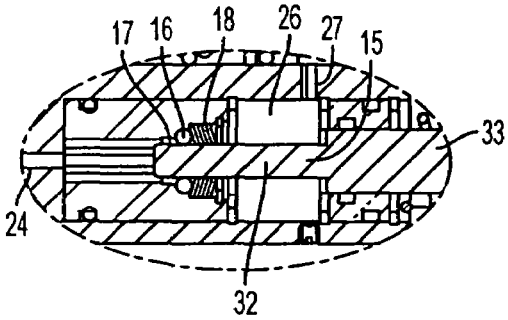
FIG. 9 is an enlarged view of the portion encircled in FIG. 7.
Figure 10:
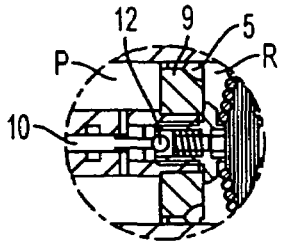
FIG. 10 is an enlarged view of the portion encircled in FIG. 7.

With the jaws grasping the work, a second mode of action applies additional force on the jaws 21 by actuating trigger 14. Note that this trigger 14 is free to move independently of gear segments 4 and 4' because of the slot 23. Prior to squeezing the trigger, the pump assembly 7 pulls fluid from the reservoir chamber P via port 24 through the check valve 16 to provide maximum volume in pump chamber 26 (FIG. 4). This action occurs upon opening the jaws 21. The trigger 14 is then squeezed or moved toward the body (FIG. 7). Squeezing trigger 14 moves links 22, thus activating pump assembly 7 by moving the pump piston 15 to the left in FIG. 2 thereby pressurizing ram chamber R and transmitting force to the jaws 21. Hence, as the pump chamber 26 volume changes (the large diameter portion 33 of the pump piston 15 replaces the small diameter portion 32) the fluid is forced via port 27 (FIG. 4) into a chamber adjacent to a bulkhead 19. The fluid then passes the O-ring check valve 8 into the ram chamber R, and is exerted on ram piston 9. Thus, a high force can be applied to the work with the hydraulic pump 7. The fluid flow automatically reseats the ram O-ring 5 preventing flow from the ram chamber R to the reservoir chamber P. The check valve 8 maintains the pressure that is built-up in the ram chamber R.

Thus, the ram assembly 2 in the tool 20 has two forward speeds. By using a ram assembly 2 with the O-ring 5, the internal spring structure 1 can drive the ram assembly 2 forward at a higher speed than the pump assembly 7 will.

To again open the jaws 21 and rest the tool 20, the pressure on the ram assembly 2 is released by letting the fluid flow through the ram piston 9. As noted above, this is done with the push rod 10 that extends through a rod portion of the ram assembly 2. The lever 11 or a cam acts on the push rod 10 at the distal end of the push rod 10 proximal to the rack gear 3. At the other end of the push rod or ram end, the push rod 10 bears against the check valve (e.g., ball) 12 in the center of the ram piston 9. The check valve 12 is opened when a force is exerted on the push rod 10 by the lever 11, permitting fluid to move from ram chamber R to reservoir chamber P.

The slider 13 associated with, or part of, the lever 11 is accessible to manually apply the force to actuate the push rod 10. As noted above, the same force also moves the rack 3, retracts the ram assembly 2, cocking the spring 1, and opening the jaws 21.

The link 22 retracts the pump assembly 7 (moves to the right in FIG. 7) and fluid flows to the pump assembly 7 via port 24. The jaws 21 can be opened a little or a lot, and they will stay as set.

The enlarged view (FIG. 4) of the pump assembly 7 shows the flow input from the left via the port 24, the pump piston 15 (small and large diameter), an O-ring 16, a backup ring 17, and a stack of Belleville springs 18 that seat the O-ring 16. As note above, the pump chamber 26 changes volume due to the two diameters of the pump piston 15. The small diameter portion 32 of the pump piston 15 is important for two reasons: it provides a sealing surface of the O-ring check valve 16 and is used in a manner such that, by the direction of motion, helps the O-ring check valve 16 open and close at the right time. The check valves 8 and 16 use O-rings as described in U.S. Pat. No. 6,341,621. However, the check valves 8 and 16 can be of any conventional configuration.

The spring structure 1 preferably includes two constant rate compression springs 1' and 1". In the embodiment, the springs 1 and 1" are placed base-to-base.

The gear rack 3 is supported on the top with rollers 29 between the gear rack 3 and the body B that are limited in travel. It is apparent that the rollers 29 will travel half the distance that the rack 3 travels, and will be kept in alignment by ends of a slot 35 containing each roller 29.

The check valves 8 and 16 are also of the type described in incorporated U.S. Pat. No. 6,341,621.

The tool 20 includes the following functional features:

a. Constant jaw force with any jaw opening.

b. Rapid closing of the jaws.

c. High clamping force.

d. Manual release.

e. Manual reset and jaw opening.

The tool 20 has been shown with jaws 21 configured as locking pliers for clamping but, it can be appreciated that the jaws 21 can be configured for crimping, cutting, bending, punching, etc.

With the tool 20, a 22-pound squeeze of the trigger can deliver about forty-five times (e.g., about 1000 pounds) clamping force on the jaws 21 due to the internal hydraulics. Furthermore, simply moving the slider 13 releases the grasp of the jaws 21. For some idea of relative strengths, a man's grip averages 50 pounds, and a woman's grip averages 30 pounds.

Figure 11:
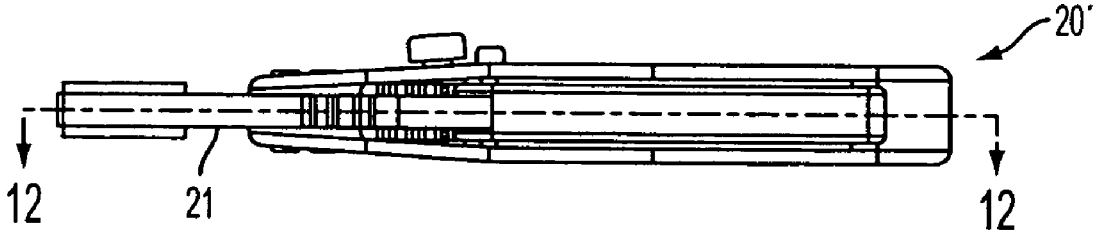
FIG. 11 is a bottom view of a fluid operated tool provided in accordance with a second embodiment of the invention, shown with jaws in a closed position.
Figure 12:
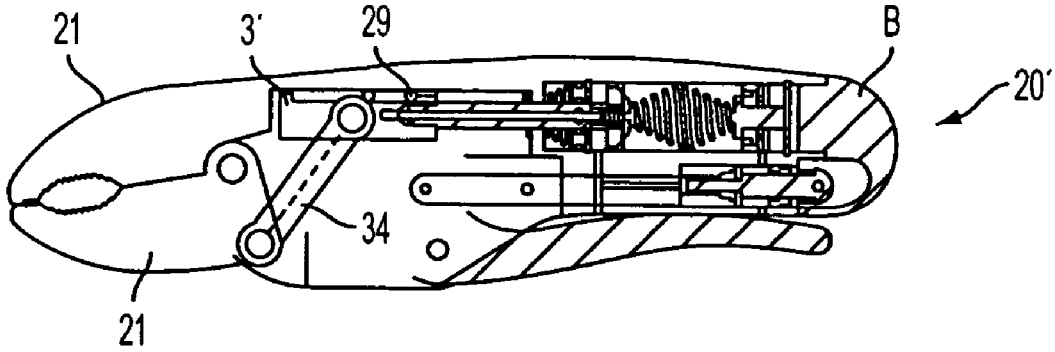
FIG. 12 is a sectional view taken along the line 12-12 in FIG. 11.

FIGS. 11 and 12 show another embodiment of a tool 20' that is the similar to the embodiment of FIG. 2, but for the actuating structure for actuating the jaws 21. In particular, the gear rack 3 has been replaced by a member 3' (e.g., the are no gear teeth on the member). Also, the gears 4 and 4' of FIG. 2 are replaced by at least one linkage 34 pinned between the slider 3' and one of the jaws 21. Thus, movement of the member 3' in the manner discussed above with regard to the gear rack 3, causes rotation of the linkage 34 and thus, movement of at least one jaw 21. Rollers 29 support the member 3' for controlled movement with respect to the body B.

Although the embodiment shows a hand tool, it can be appreciated that the tool can be configured for other applications that are not manually operated.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A hydraulically powered and operated tool comprising:

a body, a trigger mounted for movement between first and second positions with respect to the body, a pair of jaws mounted with respect to the body so that at least one of the jaws is movable between an opened jaw position and a closed jaw position so as to engage work between the jaws, jaw actuating structure associated with the at least one jaw to cause movement of the at least one jaw, a ram assembly having first and second ends and including a valve actuating structure and a ram piston, the valve actuating structure having first and second ends, the first end of the ram assembly being coupled with the jaw actuating structure, a first check valve associated with the ram piston, a second check valve associated with the ram piston and with the second end of the valve actuating structure, a lever associated with the first end of the valve actuating structure and with the ram assembly, surfaces defining a cavity in the body, the cavity having hydraulic fluid therein, the ram piston being disposed in the cavity separating the cavity to define a ram chamber and a reservoir chamber, spring structure engaging a second end of the ram assembly, and a pump assembly operatively associated with the trigger to be movable between a first position, when the trigger is in the first position, and a second position when the trigger is in a second position, the pump assembly having a pump chamber in selective fluid communication with the ram chamber and the reservoir chamber, whereby, 1) when the lever is moved to an activated position, the valve actuating structure unseats the second check valve permitting fluid to flow from the ram chamber to the reservoir chamber, with the ram assembly displacing fluid as it compresses the spring structure and causes the jaw actuating structure to move the at least one jaw so work can be placed between the jaws, and 2) when the lever is released from the activated position, the second check valve is seated and the spring structure drives the ram assembly to an extended position causing the jaw actuating structure to move the at least one jaw so the jaws engage the work, with the first check valve being unseated by fluid pressure in the reservoir chamber, permitting fluid to flow from the reservoir chamber to the ram chamber, and 3) when the trigger is moved from the first position to the second position, the pump assembly moves to the second position thereof and forces fluid from the pump chamber into the ram chamber causing the first check valve to seat, with the forced fluid being exerted on the ram piston, increasing force of the jaws on the work.

2. The tool of claim 1, wherein the valve actuating structure is a push rod and the second check valve includes a valve member associated with the ram piston, such that when the lever is moved to engage the push rod, the push rod moves and unseats the valve member permitting fluid to flow past the ram piston, and when the lever is released, a spring biases the valve member to the seated position.

3. The tool of claim 1, wherein the pump assembly includes:

a pump piston in the pump chamber, the pump piston having a first diameter portion and a second diameter portion that is larger than the first diameter portion, the trigger being connected to the pump piston, and a third check valve, permitting when unseated, fluid to flow from the reservoir chamber to the pump chamber, and when seated, preventing fluid flow from the pump chamber to the reservoir chamber, whereby, as the trigger is moved to the second position, the pump chamber changes volume due to the second diameter portion of the pump piston replacing the first diameter portion in the pump chamber, causing fluid to be forced into the ram chamber, and when the trigger is moved to the first position, fluid moves from the reservoir chamber to the pump chamber.

4. The tool of claim 1, wherein the ram piston is movably disposed in a bore in the body, and wherein the first check valve includes an O-ring disposed between a peripheral surface of the ram piston and surfaces defining the bore.

5. The tool of claim 1, wherein the jaw actuating structure includes a gear rack and first and second gear segments, the gear rack being coupled with the ram assembly, the first gear segment being engaged with the gear rack, the second gear segment being associated with at least one of the jaws, the first and second gear seconds being engaged with each other such that movement of the gear rack moves the at least one jaw.

6. The tool of claim 3, further including at least one link connecting the pump piston to the trigger.

7. The tool of claim 1, wherein the jaw actuating structure includes a member coupled with the ram assembly and a linkage between the member and at least one of the jaws, such that movement of the member moves the at least one jaw via the linkage.

8. The tool of claim 1, wherein the spring structure is a constant rate compression spring.

9. The tool of claim 5, further comprising at least one roller between the gear rack and the body to permit the gear rack to move in a controlled manner with respect to the body.

10. The tool of claim 7, further comprising at least one roller between the gear rack and the body to permit the gear rack to move in a controlled manner with respect to the body.

11. The tool of claim 1, further comprising a fourth check valve between the pump chamber and the ram chamber, the fourth check valve being constructed and arranged to permit fluid, under certain pressure conditions to pass from the pump chamber to the ram chamber.

12. The tool of claim 1, wherein the trigger and the lever are each constructed and arranged to be moved manually by hand.

13. A hydraulically powered and operated tool comprising:

a body, trigger means mounted for movement between first and second positions with respect to the body, a pair of jaws mounted with respect to the body so that at least one of the jaws is movable between an opened jaw position and a closed jaw position so as to engage work between the jaws, means for moving the at least one jaw, a ram assembly having first and second ends and including a valve actuating structure and a ram piston, the valve actuating structure having first and second ends, the first end of the ram assembly being coupled with the means for causing movement of the at least one jaw, a first means for controlling fluid flow associated with the ram piston, a second means for controlling fluid flow associated with the ram piston and with the second end of the valve actuating structure, means, associated with the first end of the valve actuating structure and with the ram assembly, for initiating tool operation, surfaces defining a cavity in the body, the cavity having hydraulic fluid therein, the ram piston being disposed in the cavity separating the cavity to define a ram chamber and a reservoir chamber, means, engaging a second end of the ram assembly, for biasing the ram assembly, and a pump assembly operatively associated with the trigger means to be movable between a first position, when the trigger means is in the first position, and a second position when the trigger means is in a second position, the pump assembly having a pump chamber in selective fluid communication with the ram chamber and the reservoir chamber, whereby, 1) when the means for initiating tool operation is moved to an activated position, the valve actuating structure unseats the second means for controlling fluid flow permitting fluid to flow from the ram chamber to the reservoir chamber, with the ram assembly displacing fluid as it compresses the means for biasing and causes the means for moving at least one jaw to move at least one jaw so work can be placed between the jaws, and 2) when the means for initiating tool operation is released from the activated position, the second for controlling fluid flow is seated and the means for biasing drives the ram assembly to an extended position causing the means for moving at least one jaw to move the at least one jaw so the jaws engage the work, with the first means for controlling fluid flow being unseated by fluid pressure in the reservoir chamber, permitting fluid to flow from the reservoir chamber to the ram chamber, and 3) when the trigger means is moved from the first position to the second position, the pump assembly moves to the second position thereof and forces fluid from the pump chamber into the ram chamber causing the first means for controlling fluid flow to seat, with the forced fluid being exerted on the ram piston, increasing force of the jaws on the work.

14. The tool of claim 13 wherein the valve actuating structure is a push rod and the second mean for controlling fluid flow includes a ball valve associated with the ram piston, such that when the means for initiating tool operation is moved to engage the push rod, the push rod moves and unseats the ball valve permitting fluid to flow past the ram piston, and when the means for initiating tool operation is released, a spring biases the ball valve to a seated position.

15. The tool of claim 13, wherein the pump assembly includes:

a pump piston in the pump chamber, the pump piston having a first diameter portion and a second diameter portion that is larger than the first diameter portion, the trigger means being connected to the pump piston, and a third means for controlling fluid flow permitting, under certain conditions, fluid to flow from the reservoir chamber to the pump chamber, and under different conditions, preventing fluid flow from the pump chamber to the reservoir chamber, whereby, as the trigger means is moved to the second position, the pump chamber changes volume due to the second diameter portion of the pump piston replacing the first diameter portion in the pump chamber, causing fluid to be forced into the ram chamber, and when the trigger means is moved to the first position, fluid moves from the reservoir chamber to the pump chamber.

16. The tool of claim 13, wherein the ram piston is movably disposed in a bore in the body, and wherein the first means for controlling fluid flow is a check valve including an O-ring disposed between a peripheral surface of the ram piston and surfaces defining the bore.

17. The tool of claim 13, wherein the means for moving at least one jaw includes a gear rack and first and second gear segments, the gear rack being coupled with the ram assembly, the first gear segment being engaged with the gear rack, the second gear segment being associated with at least one of the jaws, the first and second gear seconds being engaged with each other such that movement of the gear rack moves the at least one jaw.

18. The tool of claim 15, further including at least one link connecting the pump piston to the trigger means.

19. The tool of claim 13, wherein the means for moving at least one jaw includes a member coupled with the ram assembly and a linkage between the member and at least one of the jaws, such that movement of the member moves the at least one jaw via the linkage.

20. The tool of claim 13, wherein the means for biasing includes a constant rate compression spring.

21. The tool of claim 17, further comprising at least one roller between the gear rack and the body to permit the gear rack to move in a controlled manner with respect to the body.

22. The tool of claim 19, further comprising at least one roller between the gear rack and the body to permit the gear rack to move in a controlled manner with respect to the body.

23. The tool of claim 13, further comprising a check valve between the pump chamber and the ram chamber, the check valve being constructed and arranged to permit fluid, under certain pressure conditions to pass from the pump chamber to the ram chamber.

24. The tool of claim 13, wherein the trigger means and the means for initiating tool operation are each constructed and arranged to be moved manually by hand.

25. A hydraulic powered and operated tool comprising:

a body, a pair of jaws mounted with respect to the body so that at least one of the jaws is movable between an opened jaw position and a closed jaw position so as to engage workpiece between the jaws, a ram assembly disposed in the body and operatively associated with the jaws, first means for causing the ram assembly to move thereby causing the jaws to initially engage the workpiece with a first force, and second means for exerting fluid on the ram assembly to move the ram assembly further, causing the jaws to exert a second force, greater than the first force, on the workpiece.

26. The tool of claim 25, wherein the first means is a constant rate compression spring.

27. The tool of claim 25, wherein the second means is a pump assembly provided in the body and constructed and arranged to supply the fluid that is exerted on ram assembly.

28. A method of applying force to workpiece, the method including:

providing a hydraulic tool having a pair of jaws constructed and arranged to receive the workpiece there-between, the tool including a ram assembly operatively associated with the jaws, causing the ram assembly to move thereby causing the jaws to initially engage the workpiece with a first force, and exerting fluid on the ram assembly to cause the ram assembly to move further, causing the jaws to exert a second force, greater than the first force, on the workpiece.

29. The method of claim 28, wherein the ram assembly is caused to move at a first speed to initially engage the workpiece, and the ram assembly is caused to move by the fluid at a second speed less than the first speed.

30. The method of claim 28, wherein the step of causing the ram assembly to move to cause the jaws to initially engage the workpiece includes permitting spring structure, coupled with the ram assembly, to drive the ram assembly.

31. The method of claim 28, wherein the step of exerting fluid includes using a pump assembly in the tool to supply the fluid that is exerted on the ram assembly.

32. The method of claim 31, wherein the step of using a pump assembly includes actuating the pump assembly by manually moving a trigger associated with the pump assembly.

* * * * *